US005778818A

United States Patent [19]

Marshall

[11] Patent Number: 5,778,818

[45] Date of Patent: Jul. 14, 1998

[54] INDICATOR

[76] Inventor: Forrest A. Marshall, 615 Academy Ave., Dublin, Ga. 31021

[21] Appl. No.: 656,081

[22] Filed: May 31, 1996

Related U.S. Application Data

[63] Continuation-in-part of Ser. No. 380,598, Jan. 30, 1995, Pat. No. 5,694,882.

[51] Int. Cl.[6] ..... G09F 9/00

[52] U.S. Cl. ..... 116/313; 116/309; 116/320; 206/459.1

[58] Field of Search ..... 116/309, 311, 116/313, 318–320, 327, 328, 308; 215/230; 206/534, 459.1

[56] References Cited

U.S. PATENT DOCUMENTS

| | | | |
|---|---|---|---|
| 387,192 | 7/1888 | Velie . | |
| 557,616 | 4/1896 | Scott . | |
| 579,474 | 3/1897 | De Barry . | |
| 596,646 | 1/1898 | Altshul . | |
| 692,166 | 1/1902 | Schaffer . | |
| 710,708 | 10/1902 | McShane . | |
| 1,594,675 | 8/1926 | Kuhlman . | |
| 2,518,907 | 2/1950 | Konwal . | |
| 2,587,147 | 2/1952 | Guion et al. | 116/308 |
| 2,595,980 | 5/1952 | Neubauer . | |
| 2,713,845 | 7/1955 | Silverman . | |
| 3,032,003 | 5/1962 | Lambert et al. . | |
| 3,921,568 | 11/1975 | Fish . | |
| 4,011,829 | 3/1977 | Wachsmann et al. . | |
| 4,473,962 | 10/1984 | Winston et al. | 40/2 R |
| 4,511,050 | 4/1985 | Nicol . | |
| 4,951,596 | 8/1990 | Wallace, Jr. . | |
| 5,115,929 | 5/1992 | Buono . | |
| 5,216,975 | 6/1993 | Bartholomew . | |
| 5,271,353 | 12/1993 | Besthorne . | |
| 5,279,422 | 1/1994 | Adams . | |
| 5,331,919 | 7/1994 | Root et al. . | |
| 5,356,012 | 10/1994 | Tang et al. . | |

FOREIGN PATENT DOCUMENTS

| | | | |
|---|---|---|---|
| 361943 | 6/1962 | Switzerland | 116/320 |

OTHER PUBLICATIONS

Husted, "Dose of high–tech is in computerized pill bottle," Atlanta Journal/Constitution, Jan. 16, 1995, p. B6.

*Primary Examiner*—Diego F. F. Gutierrez
*Assistant Examiner*—Andrew Hirshfeld
*Attorney, Agent, or Firm*—Dean W. Russell; Michael F. Labbee; Kilpatrick Stockton LLP

[57] ABSTRACT

Indicators and methods of indicating are disclosed. Intended primarily for use with medicine containers, the devices typically indicate the number of doses of medication ingested or remaining to be taken by a patient during a particular period. These devices additionally provide tactile assistance to patients in appropriately repositioning the indicator arms and, when used correctly, may reduce the possibility of patient overdose by restricting improper attempts to advance the indicator arm.

12 Claims, 4 Drawing Sheets

INDICATOR

CROSS REFERENCE TO RELATED APPLICATION

This application is a continuation-in-part of U.S. patent application Ser. No. 08/380,598, filed Jan. 30, 1995, now U.S. Pat. No. 5,694,882.

FIELD OF THE INVENTION

This invention relates to an indicator and more particularly to a mechanism permitting a patient to determine the number of doses of medicine taken or remaining to be ingested in a designated interval.

BACKGROUND OF THE INVENTION

Physicians often prescribe medications requiring periodic ingestion by a patient. Products sold to patients over-the-counter, or without a practitioner's prescription, similarly typically mandate regular intake for optimal performance. Complying with these requirements necessitates that each patient recollect that doses of the medication previously were taken, as failure to do so may result in ingestion of more or less than the specified dosage during a particular period.

Many patients, however, are unable to remember or determine the amount of medication already taken over a given duration. This is especially true of certain elderly patients, who may experience short-term memory loss or, because their infirmities require ingestion of substantial numbers of different medications, confuse the dosage previously taken of each. Empirical evidence suggests that elderly glaucoma patients in particular are plagued by these problems. Combined with their decreased abilities to view the medication containers themselves, these glaucoma patients often have no means of determining whether they have taken the mandated doses.

The concept of using indicators or "medicine minders" has existed for many years. U.S. Pat. No. 710,708 to McShane, for example, describes at lines 8–13 a medicine bottle having > a scale of the full, half and quarter hours from 12 to 11.45 o'clock, together with an indicator to indicate the time of taking the medicine therein contained.

A side of the specially-molded bottle contains a "flat-topped ridge" on which a time scale is printed and having grooves to receive the "gripping claws" of an indicator. The patient is instructed to move the indicator after each dose of medication is taken, positioning its index at the point on the scale corresponding to the time for taking the next dosage. The bottle does not indicate the number of doses either taken or remaining to be taken in a particular interval, however, thus neither preventing nor inhibiting overdoses. It further fails to assist glaucoma and other patients with poor (or no) vision in appropriately positioning the indicator after ingesting each dose.

More recently, U.S. Pat. No. 5,271,353 to Besthorne issued describing a medicine reminder device in which a housing having a clock face is attached, using an elastic band, to the cylindrical body of a medicine container. Mounted to the clock face are hour and minute hands. After taking medicine from the container, the patient resets the hands to indicate the time of the next dose. As with the medicine bottle of the McShane patent, however, the reminder device of the Besthorne patent provides no indication of the doses taken or to be taken. Likewise, it furnishes patients no tactile or other non-visual assistance in appropriately repositioning the hands of the clock.

U.S. Pat. No. 4,511,050 to Nicol provides yet another type of dose indicator. Embodied in a two-piece cap, the indicator includes on one piece an embossed arrow or pointer and on the other graduated indicia. The cap is useful solely with threaded containers, however, and fails to indicate to the patient that the maximum doses have been taken during any given period.

Moreover, many medicine containers are prepackaged in an additional outer container, such as a box. Pharmacists typically attach dosage instructions to the outer container and provide the outer container to the patient unopened. The patient often opens the outer container to remove the inner container and then discards the outer container, including the dosage instructions. The patient, having discarded the dosage instructions, faces an increased risk of ingesting an improper dosage. Thus, it would be desirable to provide the patient with a dosage indicator that may be attached to an outer container by the pharmacist and then transferred to the inner container by the patient when the outer container is opened and discarded.

SUMMARY OF THE INVENTION

The present invention provides a device responsive to many of these and other drawbacks of existing indicators. Unlike those discussed above, the present invention not only provides tactile assistance to patients in appropriately repositioning its indicator arm, but also is useful with a wide variety of medicine or other containers. When used correctly, moreover, the indicator of the present invention reduces the possibility of patient overdose by restricting further (improper) movement of the indicator arm.

In certain embodiments of the present invention, the dose indicator is a molded plastic disc to which an indicator arm is connected. Affixed to the underside of the disc is a pressure-sensitive adhesive, allowing the disc to be attached to at least one surface of virtually all existing commercial medicine containers. When used with cylindrical bottles or containers having substantial curvatures, for example, such a disc may be attached to the (generally flat) upper surface of the cap of the container. When a container is prepackaged within an additional outer container, the adhesive portion may be only partially exposed, allowing the indicator to be affixed to the outer container by the pharmacist. Upon opening the outer container, the patient may expose the remaining portion of the adhesive and affix the indicator to the inner container.

For other containers, alternatively, the discs may be affixed to their front or rear faces or sides. In addition, legs may be formed on the face of the disc so that the disc can be attached to the bottom of a container. It may also be desirable to form a dose indicator integrally with the cap of the container.

Embossed on the upper surface of the disc of a first embodiment are indicia, typically numbers corresponding to doses of medicine intended for consumption by the patient. An annulus in the moveable indicator arm is designed to engage each embossed area, providing a positive (tactile) fit for the arm for each incremental dose. Additionally protruding above the upper surface are two pins or other projections which limit travel or placement of the indicator arm. One pin, whose location may be fixed for all discs, prevents the patient from attempting to place the arm outside its intended range of travel. The location of the other pin may vary, however, depending on the number of doses of medication the patient is prescribed in a particular interval (e.g. per twenty-four hours). Designed to be inserted (usually by the pharmacist) into one of a series of recesses in the disc and effectively locked into place, this pin prevents the indicator arm from traveling beyond an indicium corresponding to the maximum dose the patient is prescribed in the designated interval. As a result, it inhibits overdosing when the device is used properly by preventing the patient from advancing the arm after the final prescribed dose is taken.

In alternate embodiments, a bridge structure with numbers (or other indicia) embossed thereon is positioned on the disc. A movable arm is positioned between the bridge and the disc and can be moved to a position under each of the numbers. A biasing means is interposed between the underside of the arm and the indicator and urges the arm upward against the underside of the bridge. On the underside of the bridge, between each number is a protrusion. The protrusions provide a positive fit for the arm for each incremental dose and provide tactile feedback to the user to indicate when the arm has been moved from one position to another. The ends of the bridge form the connection between the bridge and the disc and prevent the arm from being positioned beyond its intended range of travel. A small block may be positioned between the bridge and the disc to restrict further the range of travel of the arm depending on the number of doses of medication the patient is prescribed in a particular interval (e.g. per twenty-four hours). In addition to an arm indicating that the particular dose that has been consumed, a sticker bearing a number corresponding to the number of medicinal units associated with each dose may be placed on some portion of the assembly.

Other embodiments of the invention may comprise separate caps or collars for placement about irregularly-shaped objects such as medicine droppers. Such devices may be adapted to provide more regular surfaces onto which discs may be affixed. Alternatively, other structures, including arches, may be utilized consistent with the present invention.

It is therefore an object of the present invention to provide an indicator furnishing tactile assistance to patients with poor or no vision (or operating in darkness).

It is another object of the present invention to provide an indicator that, when used correctly, may reduce the possibility of patient overdose.

It is also an object of the present invention to provide an indicator adapted to be affixed to surfaces of numerous containers.

It is a further object of the present invention to provide a disc having a moveable indicator arm that may engage a raised area of the disc to provide a positive, secure fit.

It is an additional object of the present invention to provide mechanisms limiting the range of movement of the indicator arm.

It is yet another object of the present invention to provide at least one such mechanism whose location depends on the number of doses of medicine to be taken by a patient during a particular interval.

It is an additional object of the present invention to provide visual and tactile mechanisms for informing the patient of the number of doses of medicine to be taken by the patient during a particular interval.

Other objects, features, and advantages of the present invention will become apparent with reference to the remainder of the written portion and the drawings of this application.

DETAILED DESCRIPTION

Figure 1:
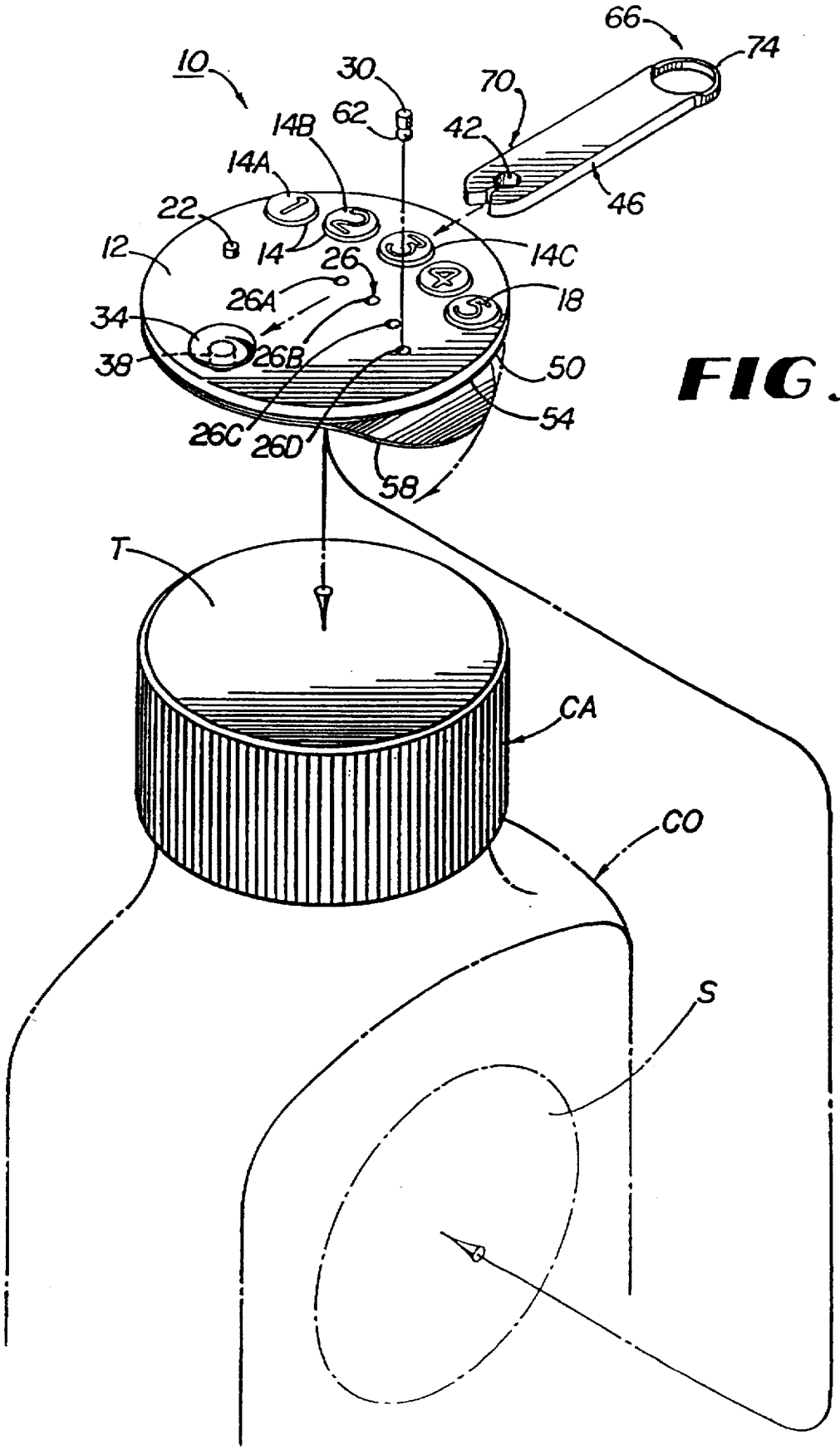
FIG. 1 is a partially-exploded perspective view of an exemplary indicator of the present invention shown prior to attachment to a bottle.
Figure 2:
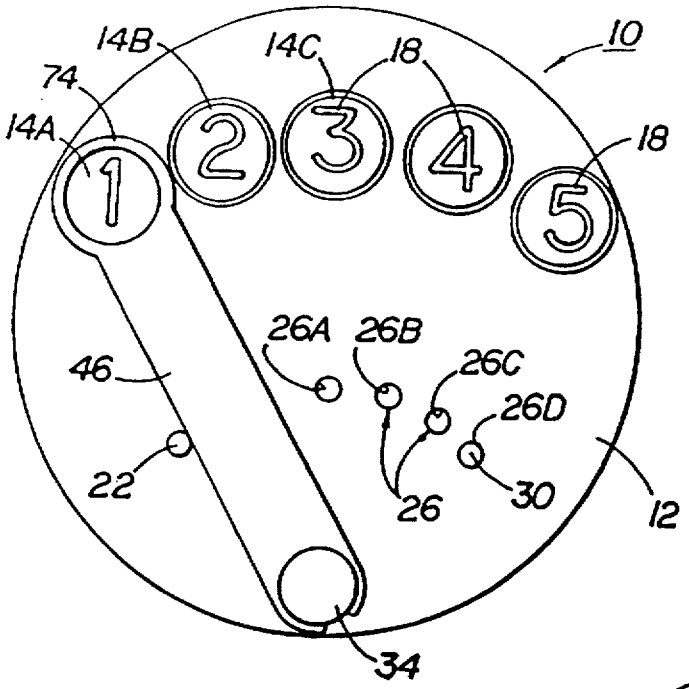
FIG. 2 is a top plan view of the indicator of FIG. 1.

FIGS. 1–2 illustrate indicator 10 of the present invention. As shown in FIGS. 1–2, indicator 10 has upper surface 12 including a series of raised, or embossed, nodes 14 in which indicia 18 appear. Also included as part of indicator 10 are pin 22 and recesses 26 into which pin 30 may be inserted, as well as retainer button 34. Formed as part of retainer button 34 is protrusion or shaft 38, which projects above upper surface 12 for receipt by bore 42 of arm 46.

Indicator 10 additionally comprises lower surface 50 to which pressure sensitive or other adhesive 54 is applied. If necessary or desired, removable backing 58 may be included to cover adhesive 54 prior to use of indicator 10. As a result, indicator 10 need not be specially made to fit particular bottles or containers, but rather may be adhered to virtually any surface of them. Similarly, most bottles or containers with which indicator 10 may be used need not be altered or specially made. Disc-shaped embodiments of indicator 10 consistent with FIGS. 1–2, moreover, may be molded of plastic or other suitable material, providing an inexpensive, disposable alternative to the medicine minders discussed above. Alternatively, indicator 10 may be, but need not be, formed integrally with the cap of the medicine container.

As illustrated in FIG. 1, removing backing 58 exposes adhesive 54. With adhesive 54 uncovered, indicator 10 may be affixed to a particular container CO. When formed as a disc, the diameter of indicator 10 is usually approximately identical to that of a cylindrical cap CA used with common pill or medicine containers. Consequently, indicator 10 can be attached readily to the top T of cap CA merely by aligning lower surface 50 with top T and manually exerting force on upper surface 12. Alternatively, indicator 10 may be attached to a face or side S of container CO (as shown in phantom lines in FIG. 1) or at any other appropriate location. Because positioning of indicator 10 is not dependent on the shape or structure of container CO, it may be affixed to the container at any time and by any of the manufacturer, pharmacist, physician, or patient.

Alternatively, backing 58 may be divided so that a small portion of surface 50 may be exposed independently of the remainder of surface 50. In this manner, a pharmacist temporarily may affix indicator 10 to an outer container, such as a box or other packaging. After the patient removes the outer container, indicator 10 may be removed therefrom and the remaining portion of backing 58 removed to expose the remainder of surface 50, allowing the indicator to be affixed to the medicine container.

Typically (although not necessarily) after lower surface 50 is attached to container CO, pin 30 and arm 46 are connected to complete indicator 10. Placement of pin 30 is made to restrict travel of arm 46 commensurate with the patient's instructions respecting the medication in container CO. As illustrated in FIG. 2, pin 30 may be positioned in any of recesses 26A–D, each recess 26 corresponding to a node 14. The exemplary indicator 10 of FIG. 1 has pin 30 inserted into recess 26D, precluding arm from moving beyond the node 14 bearing the number "5" as indicia 18. If the patient's prescription requires five doses of medication per day, for example, pin 30 would likely be inserted into recess 26D. In this manner, indicator 10 inhibits the patient from taking a sixth dose by preventing further advancement of arm 46.

Pin 30 is shown in FIG. 1 as having a spherical lower portion 62 which may be forced into a recess 26, effectively making the pin 30 irremovable by a patient. Those skilled in the art will recognize, however, that pin 30 may be fixed in place when indicator 10 is formed or assume different shapes or that other mechanisms of limiting travel of arm 46 may be employed. By contrast, pin 22 often has a fixed position, preventing the patient from pivoting or rotating arm 46 outside its intended range of motion. Like pin 30, it too may be shaped, positioned, or otherwise structured in different ways.

Arm 46 includes first and second ends 66 and 70, respectively. Formed at first end 66 is annulus 74, designed to engage each of nodes 14 as appropriate and provide a positive, tactile fit that prevents arm 46 from moving unless manually manipulated. Second end 70 of arm 46, which includes bore 42, may be bifurcated as shown in FIGS. 1–2. In use, arm 46 may be friction fitted onto shaft 38, with bore 42 receiving the shaft. Shaft 38, therefore, serves as an axle about which arm 46 may pivot between pins 22 and 30.

Although detailed in FIGS. 1–2 as raised areas, nodes 14 need not be so formed, and instead may be either recessed or flush with upper surface 12. Nodes 14 similarly need not be shaped as circles or stubby cylinders, but rather may assume other shapes as desired. In these circumstances arm 46 may either omit annulus 74 or have such an annulus shaped other than as shown in FIGS. 1–2. Alternatively, first end 66 of arm 46 may terminate in a pointer or other means for designating one of indicia 18 at any given time or be sufficiently elongated to cover an indicia 18. Likewise, notwithstanding that numerals from "1" to "5" are illustrated as indicia 18 in FIGS. 1–2, other symbols may be used instead. Moreover, if nodes 14 are somehow distinguishable from upper surface 12 (as, for example, by being raised or recessed), indicia 18 may in some cases be omitted.

In a typical scenario envisioned by the applicant, a patient receives from his or her physician a prescription requiring "X" doses of a certain medicine per day. When filling the prescription, the patient's pharmacist will affix indicator 10 to the container CO enclosing the medicine. If, for example, "X" is three (thus requiring the patient to take three doses of the medicine per day), the pharmacist inserts pin 30 into recess 26B corresponding to the node 14 bearing the numeral "3" as indicia 18. The movement of arm 46, therefore, will be limited to nodes 14 bearing the numerals "1," "2," and "3" as indicia 18.

Prior to ingesting the initial dose of medicine from container CO, the patient moves arm 46 (if necessary) to ensure that annulus 74 engages node 14A, highlighting the numeral "1" appearing on that node. The patient then ingests the initial dose and immediately rotates arm 46 so that annulus 74 engages node 14B (highlighting the numeral "2"). In this position indicator 10 thus exhibits that the first dose has been taken and that the second dose is next to be ingested. After taking the second dose, the patient moves arm 46 so that annulus 74 engages node 14C (encircling the numeral "3"). After ingesting the third dose, however, the patient cannot advance arm 46, as such movement is precluded by pin 30. Indicator 10 thus informs the patient that no further doses are required for the day, reducing the possibility of accidental overdose.

Alternatively, indicator 10 may include a "parking position," such as a node **14*n* (not illustrated) bearing the numeral "0." The pharmacist may, after inserting pin 30 into the appropriate recess, position arm 46 so that annulus 74 engages node 14*n*, thereby indicating to the patient that no doses have been consumed. After to ingesting the initial dose of medicine from container CO, the patient moves arm 46 so that annulus 74 engages node 14A, highlighting the numeral "1" appearing on that node. After ingesting the second dose, the patient rotates arm 46 so that annulus 74 engages node 14B (highlighting the numeral "2"). This process is repeated until the patient cannot advance arm 46, as such movement is precluded by pin 30, thereby informing the patient that the daily dosage has been consumed. Thereafter the patient returns arm 46** to the parking position.

Figure 4:
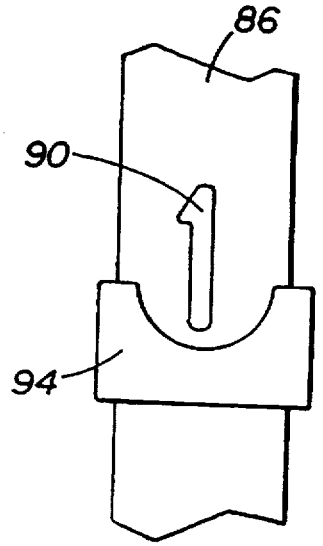
FIG. 4 is an enlarged view of a portion of the indicator of FIG. 3.
Figure 3:
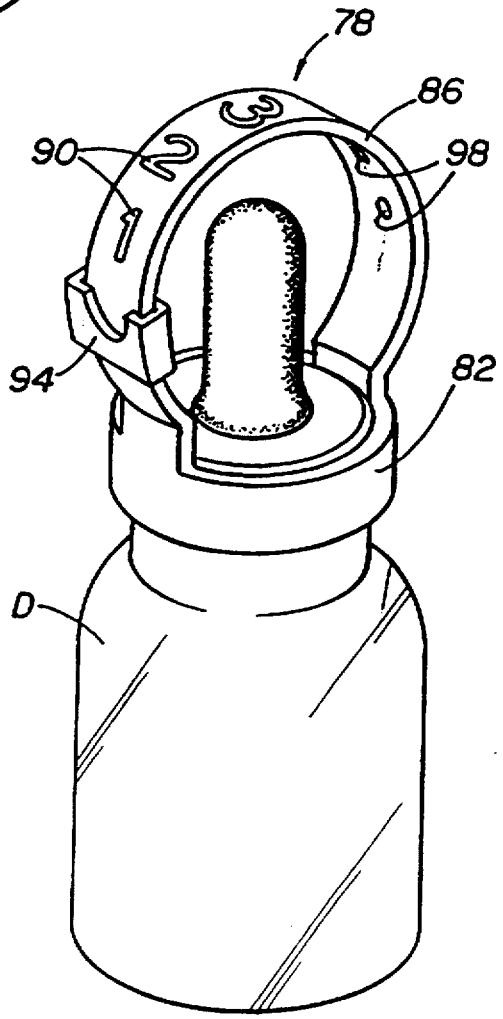
FIG. 3 is a perspective view of a first alternate embodiment of the indicator of FIG. 1.

FIGS. 3–4 illustrate an alternative indicator 78 that may be used with dropper D or other containers having irregular surfaces. As shown in FIG. 3, indicator 78 includes a removable collar 82 that may be fitted about dropper D. Connected to collar 82 is arch 86, onto which indicia 90 may be printed or otherwise included. Fitted about arch 86 is arm or slide 94, which may be moved by the patient in a manner similar to the patient's movement of arm 46. Like indicator 10, arch 86 of indicator 78 may include a series of recesses 98 into which pins or other stops may be placed to restrict advancement of slide 94. Because collar 82 effectively limits movement of slide 94, it may function equivalently to pin 22 of indicator 10. In yet another embodiment for use with dropper D, the dropper may be fitted with a separate cap onto which indicator 10 is affixed.

Figure 5:
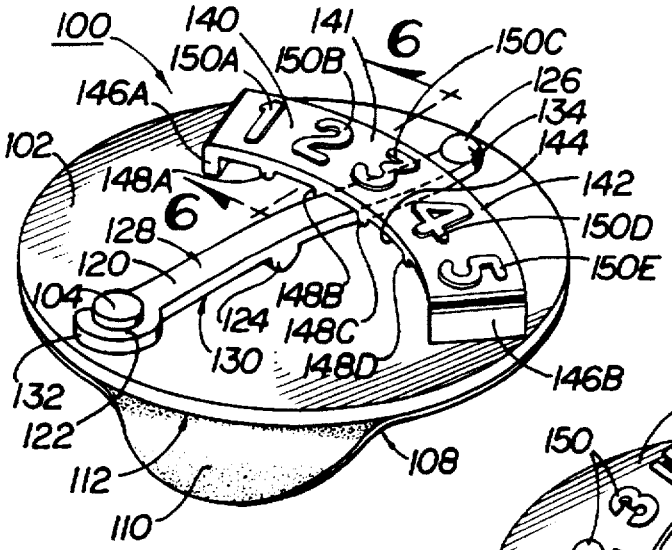
FIG. 5 is a perspective view of a second alternate embodiment of the present invention shown prior to attachment to a bottle.
Figure 6:
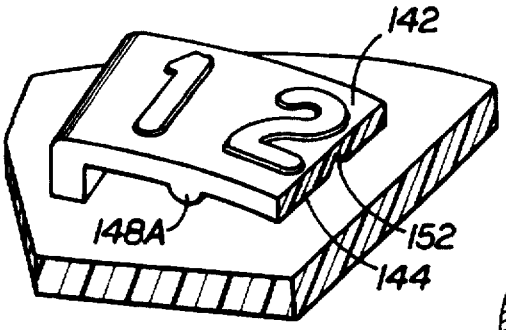
FIG. 6 is a sectional view of the bridge portion of the embodiment of FIG. 5 taken along line 6—6 of that figure.

FIGS. 5–6 illustrate indicator 100, an alternate embodiment of the present invention. As with the first embodiment (discussed above), indicator 100 comprises a lower surface 108, with adhesive 112 and a backing 110 so that the indicator 100 can be adhered to the desired container. The indicator 100 may be molded of plastic or other suitable material, providing an inexpensive, disposable alternative to the medicine minders discussed above.

Indicator 100 comprises an upper surface 102, an arm 120, a pivot 104, a bridge 140 and a movable stop 160. The arm 120 has a first end 132 and a second end 134. Formed at the first end 132 is a bore 122 which receives the pivot 104 and allows the arm 120 to rotate about the pivot 104. At the second end 134 is a knob 126 which provides the user with a tactile sensation, indicating that he or she has located the proper end 134 of the arm 120 prior to moving the arm 120. Located between ends 134 and 132 and positioned on the lower surface 130 of the arm 120 is a biasing knob 124 which rests against upper surface 102 of the indicator 100 and serves to urge the arm 120 upwards against the lower surface 144 of bridge 140.

Figure 7A:
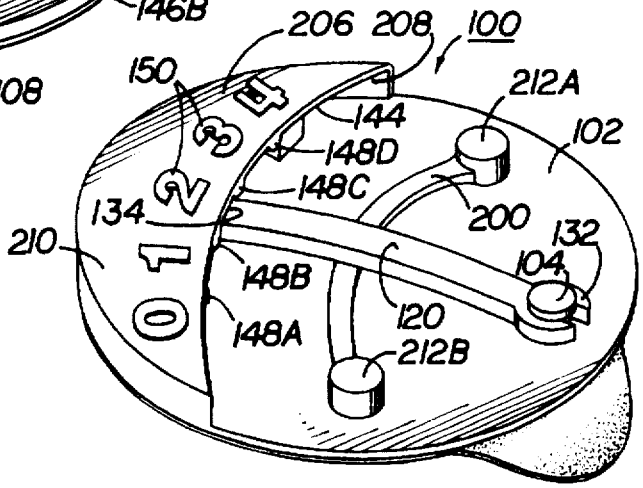
FIG. 7A is a perspective view of a third alternate embodiment of the present invention.
Figure 8A:
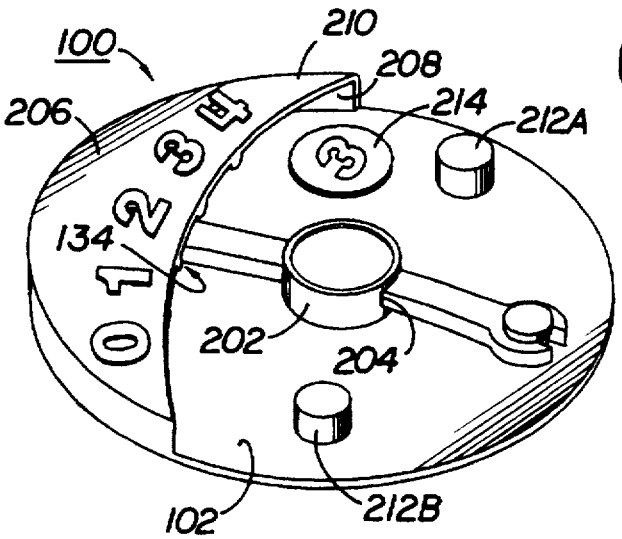
FIG. 8A is a perspective view of a fourth alternate embodiment of the present invention.
Figure 8B:
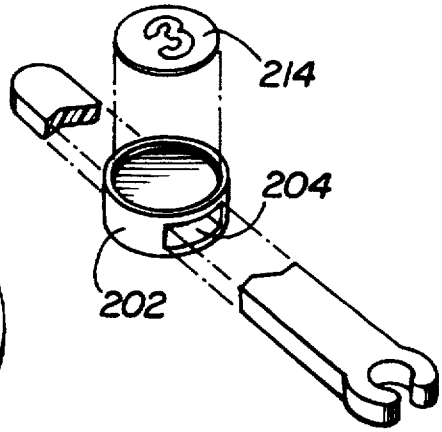
FIG. 8B is a perspective view of the movable arm and biasing means of the embodiment of FIG. 8A.

Other means for biasing arm 120 upwards may be employed. For instance, referring to FIG. 7A, a biasing rib 200 may be placed on the upper surface 102 of the indicator 100. Rib 200 may be curved to maintain a constant radial distance from pivot 104, in this manner maintaining a constant biasing force over the range of motion of arm 120. Referring to FIGS. 8A and 8B, biasing disc 202 is mounted about arm 120 and includes a portion 204 which is interposed between the arm 120 and upper surface 102 of indicator 100, thereby urging arm 120 upwards against the underside of bridge 206. Disc 202 is positioned intermedially on arm 120 so that there is sufficient room between disc 202 and bridge 206 to allow the patient to depress arm 120 with his or her finger. Disc 202 may engage arm 120 via a snap, adhesive or other affixing means, thereby retaining disc 202 in position. Disc 202 may be circular in shape, or it may take other forms, such as a square or rectangle.

As shown in FIGS. 5–6, bridge 140 comprises a cross member 141 with a top surface 142 and a bottom surface 144. Indicia 150, which may be numerals, are embossed on the top surface 142. Arm stops 148A–D protrude from bottom surface 144 and are located between each of indicia 150. Arm stops 148A–D need not (although they may) extend for the full breadth of cross member 141 (not shown). Legs 146A–B, respectively, are located at each end of cross member 141 and attach and support the bridge 140 to the upper surface 102 of the indicator 100. Legs 146 are sufficiently long to allow the arm 120 to travel beneath the cross member 141, particularly where the arm 120 must pass beneath arm stops 148. Furthermore, legs 146 act to limit the range of travel of arm 120.

Bridge 140 may take other forms. Referring to FIGS. 7A and 8A, for example, bridge 206 comprises curved wall 208 and curved plate 210, which may be matched to follow the circumference of indicator 100. End 134 of arm 120 is completely enclosed within bridge 206 and thus hidden in FIGS. 7A and 8A. Movement of arm 120 is accomplished by depressing arm 120 between rib 200 (FIG. 7A) or disc 202 (FIG. 8A) and bridge 206, thereby urging arm 120 away from the underside of bridge 206. As with the embodiment of FIGS. 5–6, arm stops 148 A–D are located on the underside of bridge 206 to position arm 120 beneath indicia 150 and provide tactile feedback to a user. Travel restraints 212A–B are provided to limit the range of travel of arm 120.

Figure 5A:
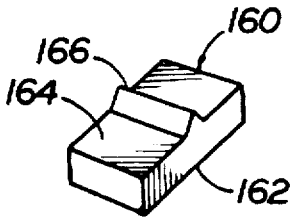
FIG. 5A is a perspective view of the movable stop of the embodiment FIG. 5.
Figure 7B:
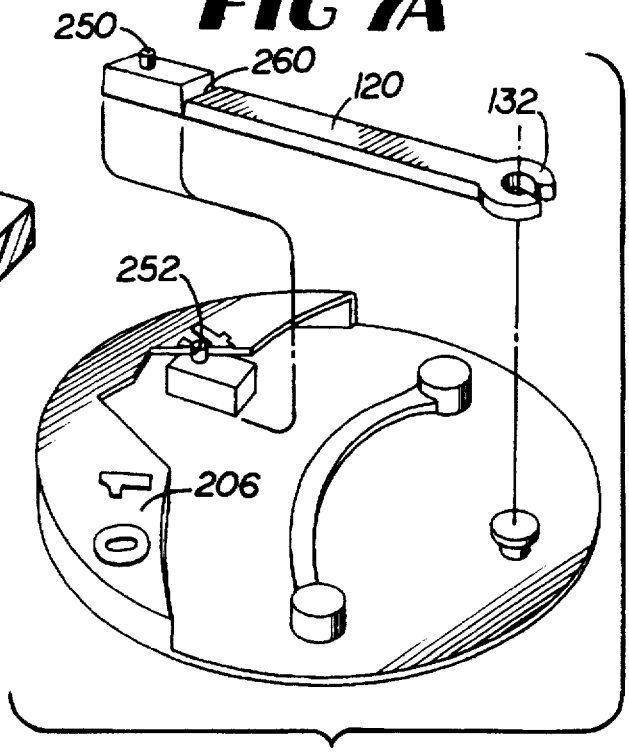
FIG. 7B is a partial cutaway and exploded view of the embodiment of FIG. 7A.

Referring to FIG. 5A, movable stop 160 is a small block sized to fit snugly between cross member 141 and top surface 102 and to span the width of no more than one indicia 150, i.e., between two adjacent arm stops 148. Movable stop 160 has a protrusion 166 extending from its top surface 164 for seating the movable stop 160 into position. The protrusion 166 may, but need not, span the width of movable stop 160. Furthermore, protrusion 166 may alternatively be placed on the bottom surface 162 of movable stop 160. As illustrated in FIG. 6, an indentation 152 is provided on the lower surface of cross member 141. Indentation 152 is shaped to match the size and shape of protrusion 166, and alternatively may be placed on the upper surface 102 of indicator 100 should protrusion 166 be located on the bottom surface 162 of movable stop 160. Indentation 152 cooperates with protrusion 166 of movable stop 160 to hold the movable stop 100 in place when it is positioned between the cross member 141 and the upper surface 102 of indicator 100. Thus, movable stop 160 can be positioned to prevent the arm 120 from traveling beyond a certain point. As shown in FIG. 7B, movable block 160 may also be retained beneath bridge 206 by peg 250 which is inserted into opening 252 of bridge 206.

Movable stop 160 may be provided to the pharmacist attached or molded in one piece with arm 120. Fracture groove 260 is provided to allow movable stop 160 to be separated from end 134 of arm 120 prior to use. In such instance, the pharmacist separates movable stop 160 and inserts it under bridge 206 in the appropriate location. Thereafter, the pharmacist attaches arm 120 to indicator 100. In this manner the potential for loss or misplacement of movable stop 160 prior to use of indicator 100 is minimized. Indicator 100 is operated in much the same fashion as discussed above with respect to the first embodiment. The pharmacist positions movable stop 160 underneath the bridge to correspond to the number of daily doses prescribed.

Referring to FIG. 8A, in addition to movable stop 160, sticker 214 may be placed on indicator 100 to indicate the number medicinal units associated with each of the daily doses. For instance, if a patient must take two pills, three times a day, the pin or block may be positioned to restrict the travel of the indicator arm so that it may not travel beyond the indicium bearing the number "3." A sticker bearing the number "2" is then placed elsewhere on the assembly to remind the patient that two pills must be consumed to satisfy a dose. Sticker 214 may be preprinted or blank to allow the pharmacist to write on it the appropriate number. Sticker 214 may be placed on disc 202 or elsewhere on indicator 100.

As the patient takes each dose on a given day, arm 120 is pivoted underneath bridge 140 so that it rests under a given indicia 150. The operation may be performed by depressing knob 126 and sliding arm 120 in the desired direction. As the arm 120 passes under arm stops 148, a tactile sensation (a snap) is detectable, thus indicating to the user that the arm 120 has been moved one position. Once in position, biasing knob 124 urges arm 120 upwards against cross member 141 in between two adjacent arm stops 148, thus holding arm 120 firmly in position. This operation is repeated until arm 120 is stopped by movable stop 160, indicating that the doses for that day have been consumed. Alternatively, the patient may refer to sticker 214. When arm 120 is pointing to an indicium 150 that corresponds with the indicium on sticker 214, the patient knows the daily dosage has been met and resets arm 120. Movable stop 160 may be used in combination with sticker 214 to provide redundancy and therefore additional assurance than the correct dosage has been consumed.

Figure 9:
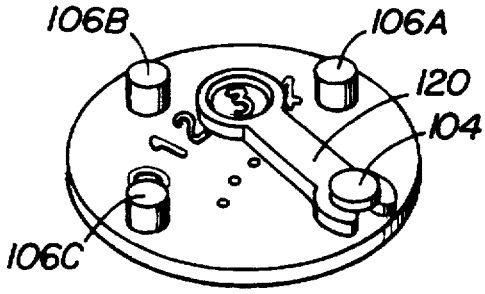
FIG. 9 is a perspective view of an embodiment of the invention including legs for allowing the indicator to be attached to the bottom of a bottle.
Figure 10:
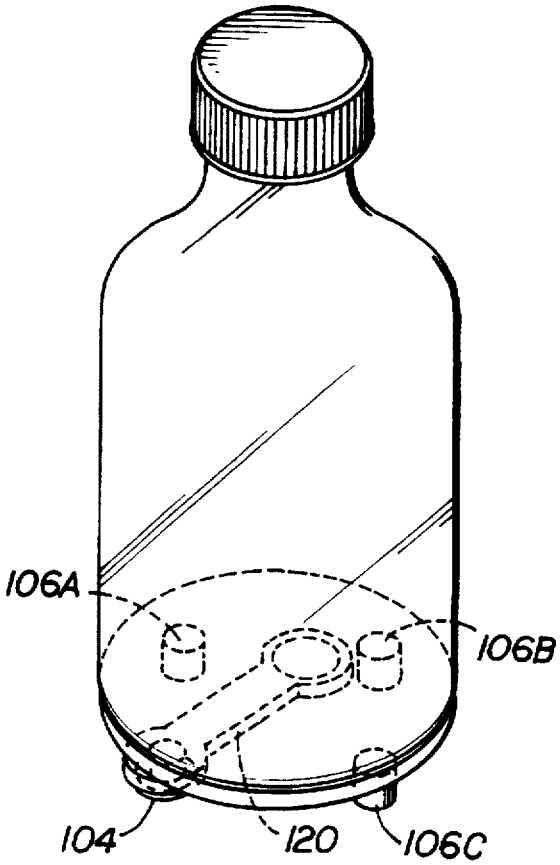
FIG. 10 is a perspective view of the embodiment of FIG. 9 shown attached to the bottom of a bottle.

As shown in FIG. 9, an alternate embodiment of the indicator 100 has upper surface 102 including a series of optional legs 106A–C and a pivot 104. Optional legs 106A–C may be provided so that indicator 100 can be attached to the bottom of a bottle while allowing the bottle to be placed in an upright position for storage, as illustrated in FIG. 10. In the event that optional legs 106A–C are provided, pivot 104 can also serve as a leg provided it has the same height as legs 106A–C. The positioning of legs 106A–C may be varied to provide an appropriate aesthetic appearance provided the legs 106A–C can still maintain the bottle in an upright position.

The foregoing is provided for purposes of illustrating, explaining, and describing embodiments of the present invention. Modifications and adaptations to these embodiments will be apparent to those skilled in the art and may be made without departing from the scope or spirit of the invention. In particular, although the devices and method disclosed herein are primarily intended for use with medicine containers, their usage is not so limited, and they may be employed whenever indications such as they provide are desired.

I claim:

1. An indicator comprising:

a. an upper surface;

b. an arm;

c. means for attaching the arm to the upper surface of the indicator so that the arm may move, in which the attaching means protrudes from the upper surface of the indicator and about which the arm pivots;

d. means, attached to the upper surface of the indicator and defining a space therebetween, for receiving the arm in which the receiving means has an upper surface and a lower surface, further comprising a plurality of nodes protruding from the lower surface of the receiving means and indicia located on the upper surface of the receiving means, each indicium located between an adjacent two of the nodes;

e. in which the arm is of a width to fit between an adjacent two of the nodes f. in which the arm has a upper surface and a lower surface, the arm further comprising a knob protruding from the lower surface of the arm for biasing the arm against the lower surface of the receiving means; and g. means, adapted to be inserted into the space, for restricting movement of the arm.

2. An indicator according to claim 1 further comprising a plurality of legs attached to the upper surface of the indicator for attachment to the bottom of a bottle.

3. An indicator comprising:

a. an upper surface;

b. an arm;

c. means for attaching the arm to the upper surface of the indicator so that the arm may move, in which the attaching means protrudes from the upper surface of the indicator and about which the arm pivots;

d. means, attached to the upper surface of the indicator and defining a space therebetween, for receiving the arm in which the receiving means has an upper surface and a lower surface, further comprising a plurality of nodes protruding from the lower surface of the receiving means and indicia located on the upper surface of the receiving means, each indicium located between an adjacent two of the nodes;

e. in which the arm is of a width to fit between an adjacent two of the nodes f. in which the arm has a upper surface and a lower surface, the arm further comprising a rib protruding from the upper surface of the indicator for biasing the arm against the lower surface of the receiving means; and g. means, adapted to be inserted into the space, for restricting movement of the arm.

4. An indicator according to claim 3 in which the rib is curved to maintain a constant radial distance from the attaching means.

5. An indicator according to claim 3 further comprising a plurality of legs attached to the upper surface of the indicator for attachment to the bottom of a bottle.

6. An indicator comprising:

a. an upper surface;

b. an arm;

c. means for attaching the arm to the upper surface of the indicator so that the arm may move, in which the attaching means protrudes from the upper surface and about which the arm pivots;

d. means, attached to the upper surface of the indicator and defining a space therebetween, for receiving the arm in which the receiving means has an upper surface and a lower surface, further comprising a plurality of nodes protruding from the lower surface of the receiving means and indicia located on the upper surface of the receiving means, each indicium located between an adjacent two of the nodes;

e. in which the arm is of a width to fit between an adjacent two of the nodes f. in which the arm has a upper surface and a lower surface, the arm further comprising a disc affixed about the arm for biasing the arm against the lower surface of the receiving means; and g. means, adapted to be inserted into the space, for restricting movement of the arm.

7. An indicator according to claim 6 further comprising a sticker attached to the disc.

8. An indicator according to claim 6 further comprising a plurality of legs attached to the upper surface of the indicator for attachment to the bottom of a bottle.

9. A device for indicating doses of medication comprising:

a. an upper surface;

b. a shaft protruding from the upper surface;

c. two support legs protruding from the upper surface;

d. a cross member attached to the two support legs having a top surface and a bottom surface;

e. a plurality of nodes attached to the bottom surface of the cross member;

f. indicia in the form of numerals appearing on the top surface of the cross member, each indicium located between an adjacent two of the nodes;

g. a moveable arm having a first end defining a bore for receiving the shaft, a second end, and a portion adjacent to the second end which is positioned between the cross member and the upper surface; and h. a block sized to fit snugly between the upper surface and the cross member, for restricting movement of the arm to portions of the upper surface bounded at least in part by one of the two support legs and the block.

10. The device according to claim 9 further comprising a plurality of legs attached to the upper surface for attachment to the bottom of a bottle.

11. The device according to claim 9 further comprising means for biasing the arm against the cross member.

12. The device according to claim 9 in which, prior to the first use of the device, the block is frangibly attached to the arm.

* * * * *